US007096779B2

(12) United States Patent
Brendel et al.

(10) Patent No.: US 7,096,779 B2
(45) Date of Patent: Aug. 29, 2006

(54) CALENDER ARRANGEMENT

(75) Inventors: Bernhard Brendel, Grefrath (DE); Peter Svenka, Grefrath (DE)

(73) Assignee: Eduard Küsters Maschinenfabrik GmbH & Co. KG, Krefeld (DE)

( * ) Notice: Subject to any disclaimer, the term of this patent is extended or adjusted under 35 U.S.C. 154(b) by 77 days.

(21) Appl. No.: 11/009,596

(22) Filed: Dec. 10, 2004

(65) Prior Publication Data

US 2005/0160924 A1 Jul. 28, 2005

Related U.S. Application Data

(63) Continuation-in-part of application No. 10/313,985, filed on Dec. 5, 2002, now abandoned, which is a continuation-in-part of application No. 09/424,076, filed as application No. PCT/EP99/01412 on Mar. 4, 1999, now abandoned.

(30) Foreign Application Priority Data

Mar. 17, 1998 (DE) ..... 198 11 474

(51) Int. Cl.
*B30B 15/14* (2006.01)
*B30B 3/04* (2006.01)

(52) U.S. Cl. ..... 100/161; 100/47; 100/162 B; 100/172; 100/331

(58) Field of Classification Search ..... 100/47, 100/161, 162 R, 172, 162 B, 163 R, 164, 100/165, 331, 163 A
See application file for complete search history.

(56) References Cited

U.S. PATENT DOCUMENTS

| | | | | |
|---|---|---|---|---|
| 359,294 | A | 3/1887 | Thom | |
| 1,179,737 | A | 4/1916 | Manly | |
| 4,222,255 | A | 9/1980 | Lenmann | |
| 4,510,823 | A * | 4/1985 | Leech | 74/410 |
| 4,736,678 | A | 4/1988 | Stotz | |
| 4,890,551 | A | 1/1990 | Dahl et al. | |
| 5,655,442 | A * | 8/1997 | Conrad et al. | 100/331 |
| 5,669,295 | A | 9/1997 | Kayser et al. | |
| 5,771,793 | A * | 6/1998 | Kayser | 100/47 |
| 5,784,955 | A | 7/1998 | Conrad | |
| 5,791,242 | A | 8/1998 | Kayser et al. | |
| 6,095,039 | A | 8/2000 | Brendel et al. | |
| 6,234,075 | B1 | 5/2001 | Kayser | |
| 6,248,215 | B1 | 6/2001 | Crammer et al. | |

FOREIGN PATENT DOCUMENTS

| | | |
|---|---|---|
| DE | 19650576 | 6/1998 |
| DE | 19757473 C3 | 6/2003 |
| GB | 1156937 | 9/1966 |

* cited by examiner

*Primary Examiner*—Derris H. Banks
*Assistant Examiner*—Jimmy T. Nguyen
(74) *Attorney, Agent, or Firm*—Townsend and Townsend and Crew LLP

(57) ABSTRACT

A vertical calender arrangement comprises a controllable-deflection top roll, a controllable-deflection bottom roll and intermediate rolls arranged between top and bottom rolls. The top roll and the bottom roll are each provided with a power drive.

2 Claims, 5 Drawing Sheets

CALENDER ARRANGEMENT

CROSS-REFERENCES TO RELATED APPLICATIONS

This application is a continuation-in-part of application Ser. No. 10/313,985, filed on Dec. 5, 2002, now abandoned, which was a continuation-in-part of application Ser. No. 09/424,076, filed on Feb. 15, 2000 now abandoned, which was a 371 of PCT/EP99/01412, filed on Mar. 4, 1999, which claimed priority from German application no. 19811474.5, filed on Mar. 17, 1998. The full disclosures of each of these applications are incorporated herein by reference.

BACKGROUND OF THE INVENTION

1. Field of the Invention

The invention relates to a calender arrangement.

2. Description of the Background Art

In vertical calenders having a plurality of rolls, one of the intermediate rolls is provided with a main drive and transmits the torques to all the other rolls frictionally, by means of tangential forces, from one roll to the next and via the web to be treated and the roll covers. This leads to undesired horizontal deflections, that is to say to deformations of the intermediate rolls. In addition, the web structure and the roll covers are impaired. FIG. 1 shows a schematic side view of a known off-line calender, in which an intermediate roll 2, that is the drive roll with a main drive, is driven.

In an on-line calender, before the paper web is threaded, and with the nips open, all the rolls in contact with the paper web are accelerated by their auxiliary drives, and the drive roll with the main drive is accelerated to a rotational speed at which the respective circumferential speed corresponds to the web speed of the paper, which can be 1000 m per minute and much higher. After the nips have been closed, power is introduced only by the main drive of a single drive roll. This is illustrated schematically in FIG. 2, in which the main drive 4 is represented by a large drive symbol and the auxiliary drives 6 are represented by a small drive symbol. In FIGS. 1 and 2, the horizontal deflections at the centre of the roll are drawn schematically as a centre offset.

In modern calenders, the top roll and the bottom roll of the roll stack are designed as controllable-deflection rolls. Because of their internal frictional losses, necessitated by their functioning, these two rolls need a greater drive force than the remaining calender rolls. In addition, the most extreme deformation of the paper web takes place in the first nip. In conventional calenders having a main drive, these two power components have to be dragged through the entire roll stack and, in so doing, stress the paper web and the roll covers in a damaging way as a result of frictional transmission of the tangential forces. This results in increased wear of the roll surfaces and a reduction in the service life of the rolls.

According to an earlier proposal in DE-196 50 576.3, all the rolls are provided with their own (power) drives, and the powers of the individual drives are coordinated with one another in such a way that the horizontal roll deformations are minimized.

BRIEF SUMMARY OF THE INVENTION

The object of the invention is to provide a calender whose roll drive is designed such that the outlined disadvantages of the prior art are avoided in a cost-effective manner.

DETAILED DESCRIPTION OF THE INVENTION

According to the invention, the controllable-deflection rolls are each provided with their own power drive. In one configuration of the invention, a controllable-deflection top roll and bottom roll can be driven with drive powers matched to each other. It is preferred to register the horizontal deformation of an intermediate roll and to control or regulate the power distribution to the two drives in such a way that this deformation at least remains below an amount which is still permissible. It has been shown that this requirement can be met if the top roll and bottom roll are driven with essentially the same power.

Figure 1:
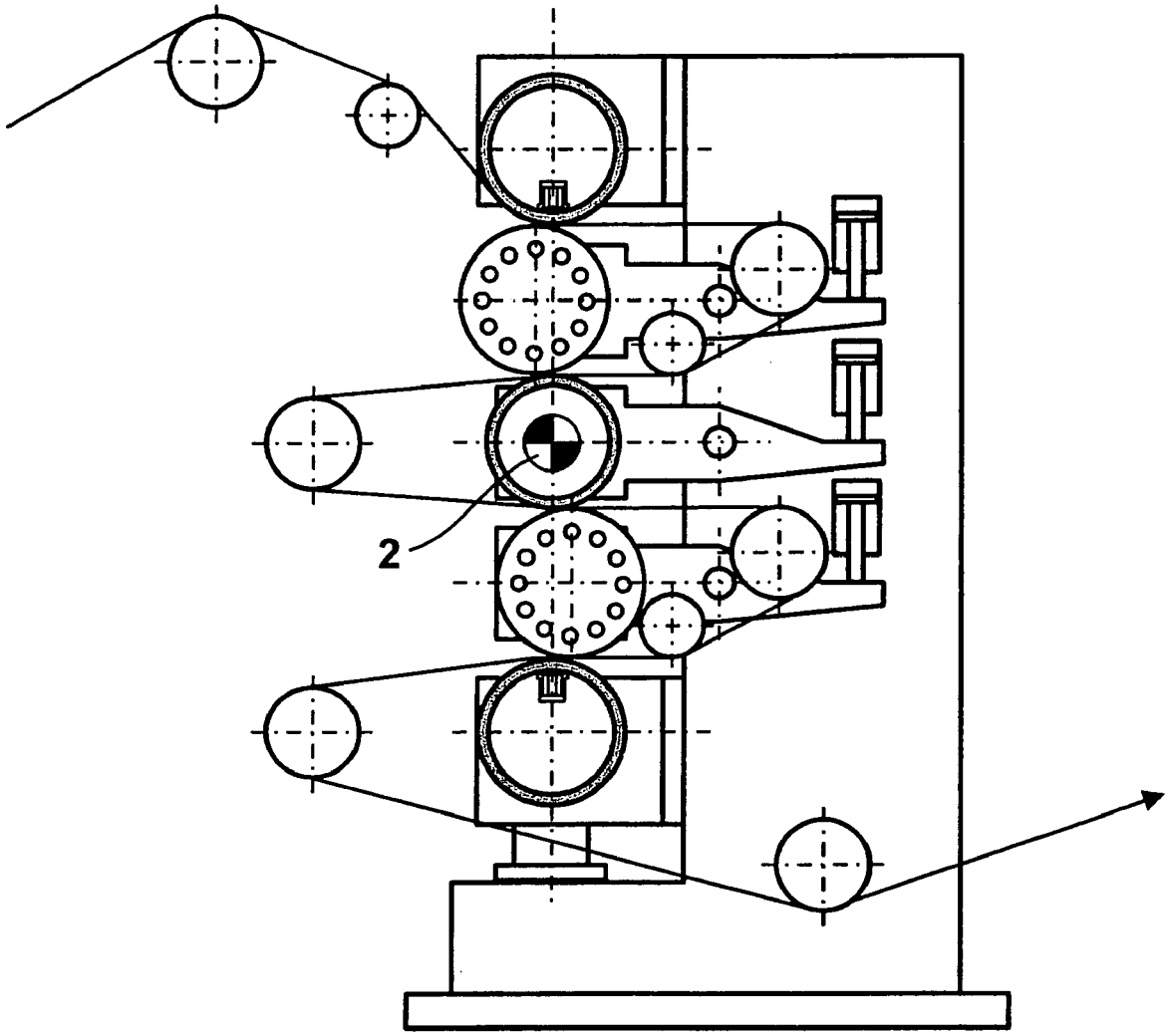
Prior Art Fig. 1
FIG. 1 illustrates a prior art off-line calender having an intermediate roll that acts as a drive roll.
Figure 2:
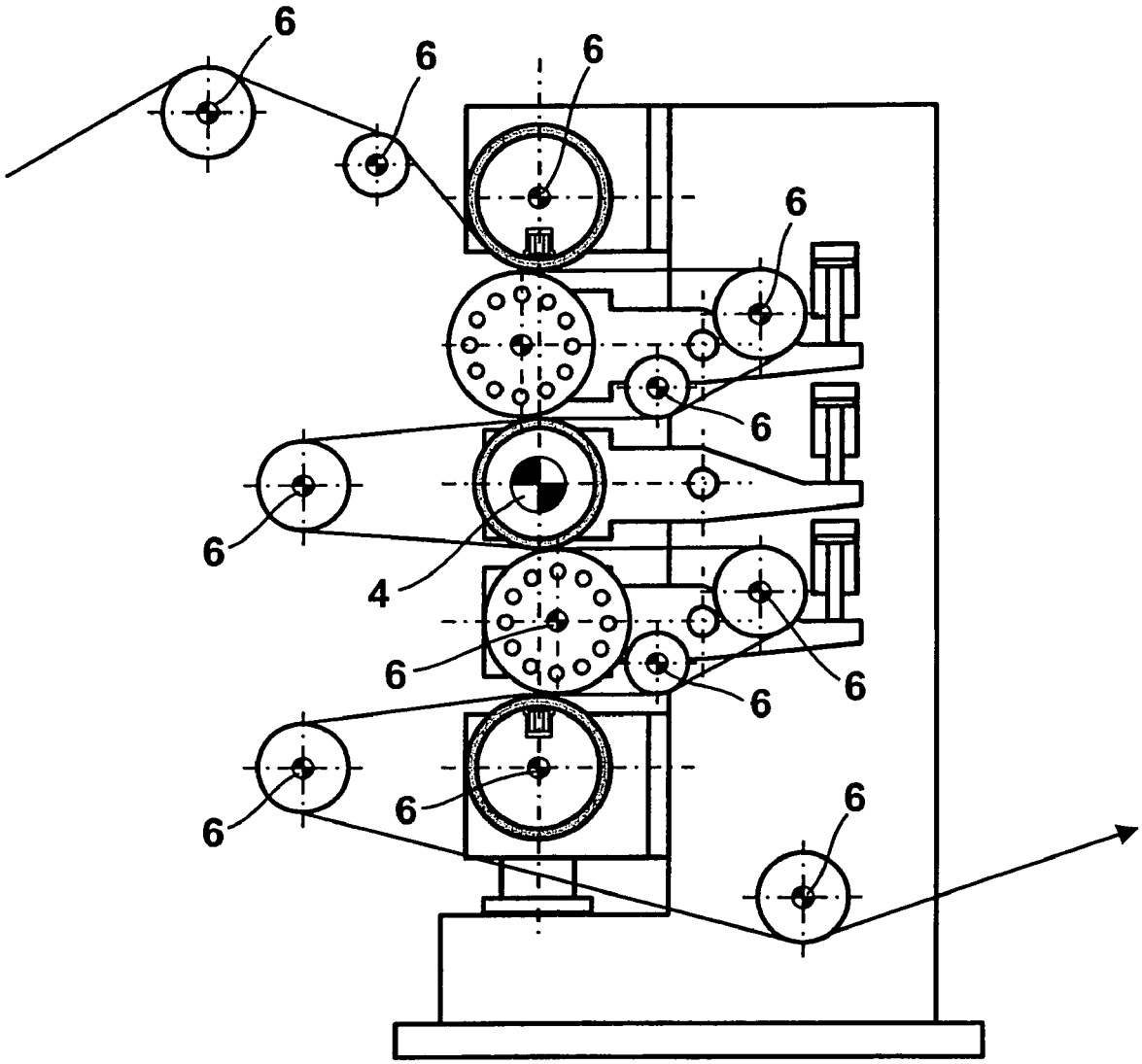
Prior Art Fig. 2
FIG. 2 illustrates a prior art on-line calender having a main drive and auxiliary drives.
Figure 3:
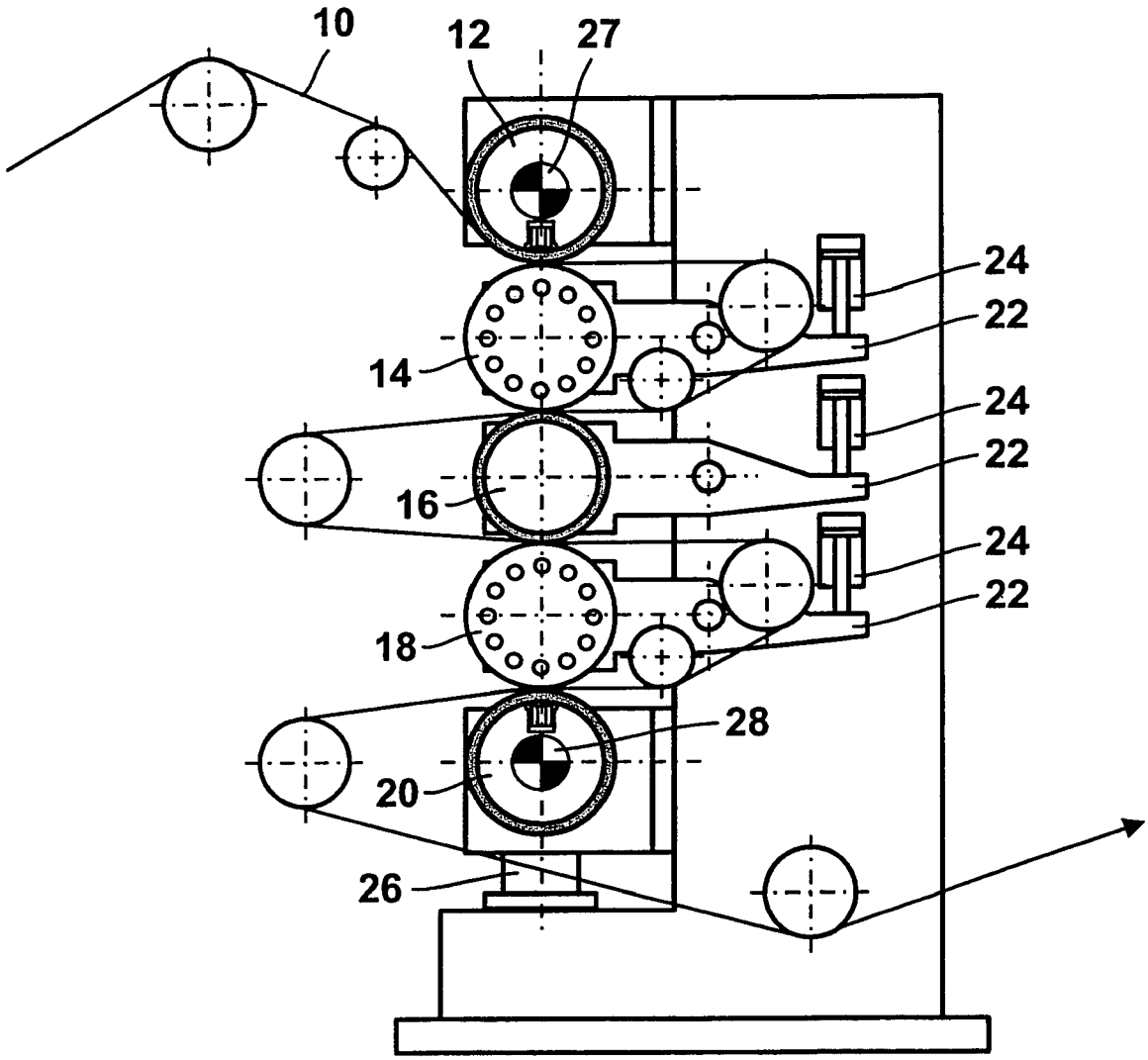
FIG. 3 illustrates a first embodiment of a calender apparatus according to the present invention.
Figure 4:
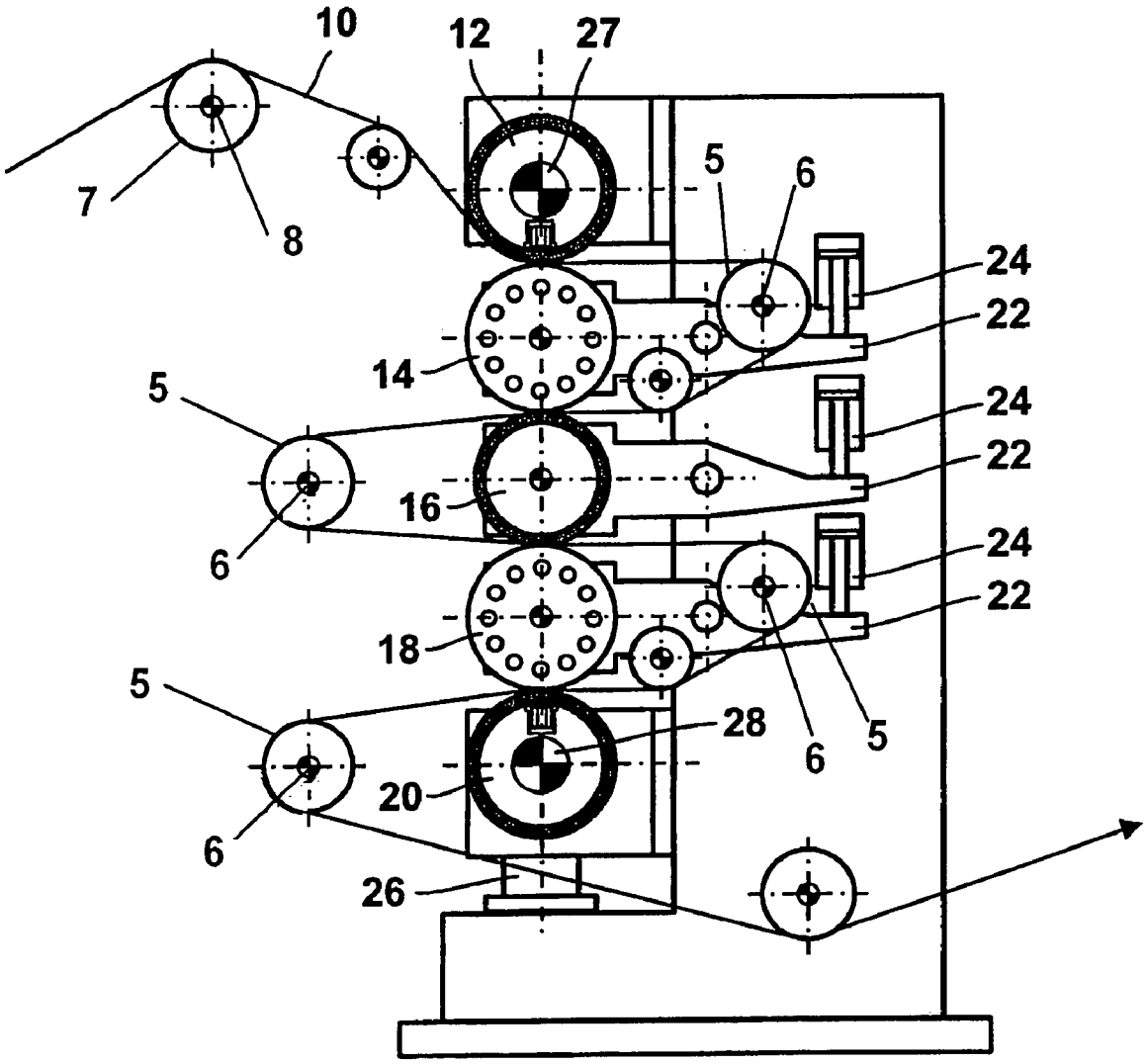
FIG. 4 illustrates a second embodiment of a calender apparatus according to the present invention.

Two embodiments of the calender arrangement according to the invention are reproduced schematically in side view in the appended FIGS. 3 and 4. Here, FIG. 3 shows a calender arrangement analogous to FIG. 1, while FIG. 4 represents a calender arrangement analogous to FIG. 2. The symbols for the power drive and auxiliary drive in FIG. 3 and FIG. 4 correspond to the symbols for the main drive and auxiliary drive in FIGS. 1 and 2.

After the nips have been closed, the calender rolls have the predefined line load applied to them, at which predefined pressure stresses are developed in the nips. At the same time, the calendering forces corresponding to the loading are provided by the two power drives of the top and bottom rolls. An intermediate roll is expediently provided with sensors for the horizontal deformations, and the distribution of the drive power to the top and bottom roll is carried out in such a way that these horizontal deformations are minimized. Alternatively, it is also possible for the horizontal forces acting on an intermediate roll to be measured and minimized.

In the embodiments according to the invention according to FIGS. 3 and 4, the paper web 10 runs firstly into the nip formed between the upper controllable-deflection roll 12 and the first intermediate roll 14, which is a heatable hard roll. After this, the paper web passes into the nip formed between the latter roll and a central intermediate roll 16; roll 16 is provided with a resilient cover. On the side facing away from roll 14, roll 16 forms, with a second heatable hard roll 18, the next nip through which the paper web 10 passes. A last nip is formed between roll 18 and the bottom controllable-deflection roll 20. The rolls 12 and 20 are equipped with main power drives, 27 and 28, respectively. The product web 10 is lead between the individual nips around the guide rolls 5. The guide rolls 5 are each provided with their own power drive 6. The surfaces of the guide rolls 5 are preferably provided with spiral grooves to ensure that the product web is kept spread out. Normal spreader roll(s) 7 may also be provided. The spreader roll(s) 7 are each provided with their own drive(s) 8.

Figure 5:
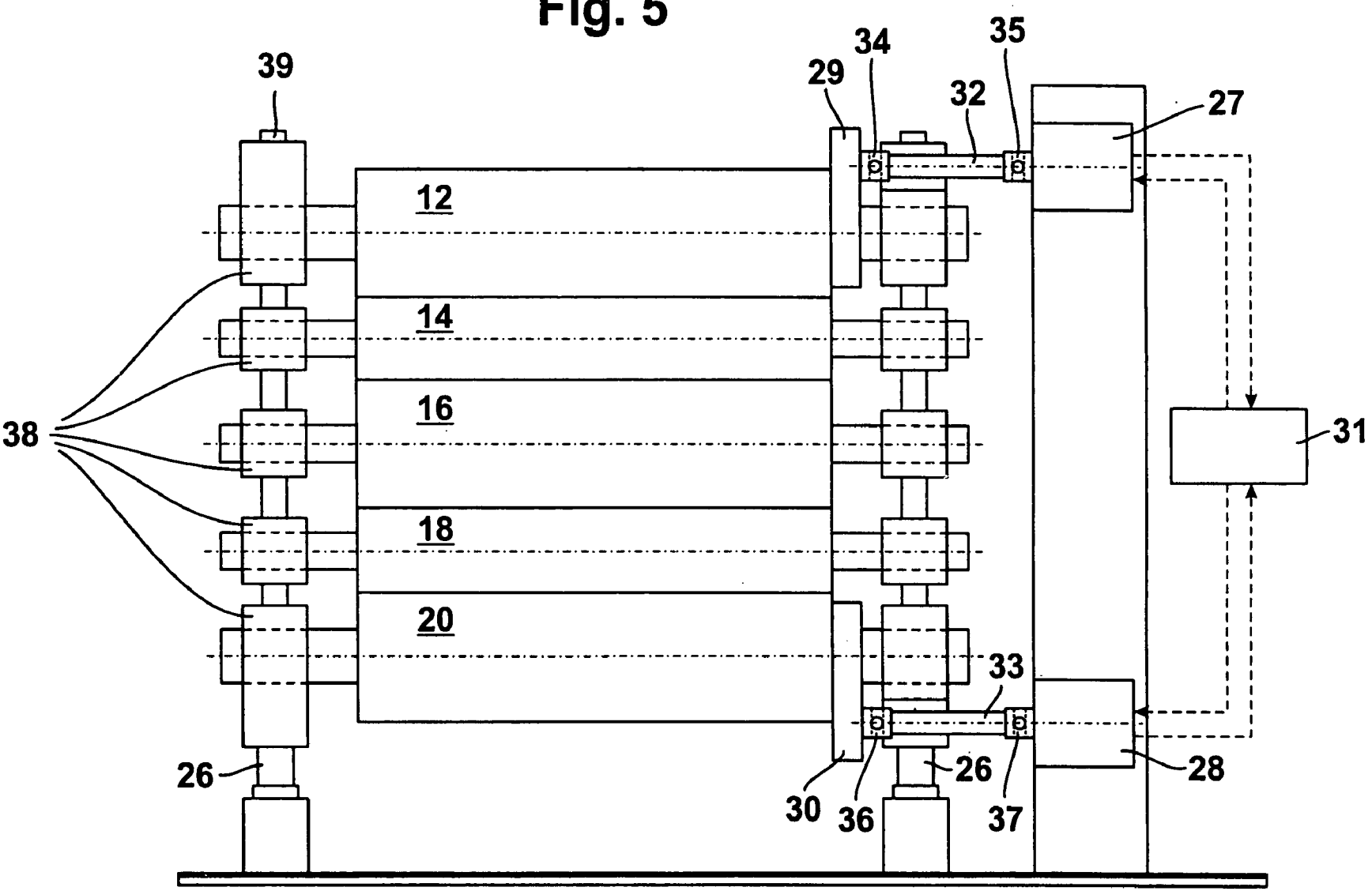
FIG. 5 illustrates a front view of the first embodiment of the calender apparatus according to FIG. 3.

As shown in FIG. 5 the first main power drive 27 is connected via a first gear mechanism 29 to the top roll 12, and the second main power drive 28 is connected via a second gear mechanism 30 to the bottom roll 20, wherein the first and second gear mechanisms 29, 30 have the same construction. In this way, equal torques may be applied to the upper roll 12 and the bottom roll 20 using power drives 27, 28 driven at substantially the same power. A control unit 31 can be used to apply substantially the same power to the first and second power drives 27, 28.

The first and second gear mechanisms 29, 30 preferably comprise slip-on gear mechanisms. Each slip-on gear is connected to the roll sleeve of the controllable deflection rolls 12, 20. Cardan shafts 32, 33 are used to bridge the power drive 27, 28 and the gear mechanisms 29, 30, respectively. Cardan joints 34, 35 and 36, 37 are associated with each cardan shaft 32, 33.

The rolls 12, 14, 16, 18, 20 are supported via bearing housings 38 at a calender stand 39. The intermediate rolls 14, 16 and 18 are mounted in a manner known per se in lever arms 22, via which forces from operating cylinders 24 can be introduced, in particular in order to compensate for the so-called overhung loads. Hydraulic units 26 are used to close the nips; instead of this, the inner stroke of the roll 20 could also be used for this purpose, while the upper controllable-deflection roll 12 is mounted in a fixed location in the frame.

On one of the intermediate rolls 14, 16, 18, transverse forces which occur can be measured via sensing elements (not illustrated) and, depending on the measurement result, the power distribution of the drives 27 and 28 for the top roll 12 and the bottom roll 20 can be adjusted, in order that these transverse forces do not exceed a predefined value. Alternatively, possible deformations of the intermediate rolls 14, 16, 18, in particular at their roll centre, can be measured by means of measuring elements. This measurement result can be included in the power distribution of the drives 27 and 28 for the top roll 12 and the bottom roll 20, in order also to minimize these deformations.

It should further be noted that the concept according to the invention is particularly suitable for re-equipping existing calenders, in which there is often a lack of space, or for narrower machines having a relatively low drive power and relatively stiff intermediate rolls.

What is claimed is:

1. A vertical calender apparatus for treating a paper web, said apparatus comprising:

a controllable-deflection top roll;

a controllable-deflection bottom roll;

a plurality of auxiliary drives;

a plurality of guide roll drives;

a plurality of intermediate guide rolls arranged between the top roll and the bottom roll to define a calender stack, two of the plurality of intermediate guide rolls are heatable hard rolls and a central one of the plurality of intermediate guide rolls is provided with a resilient cover, each intermediate roll coupled to one of the auxiliary drives for in-line operation to pull in the paper web during operation;

a plurality of guide rolls arranged adjacent to the calender stack, each guide roll coupled to one of the guide roll drives;

a first main power drive to transmit torques to all the rolls frictionally, the first main power drive connected to the top roll via a first gear mechanism;

a second main power drive connected to the bottom roll via a second gear mechanism, wherein the first and second gear mechanism have the same construction such that equal torques is applied to the top and bottom rolls using the first and second main power drives at substantially the same power; and a control unit for applying substantially the same power to the first and second main power drives to drive the top and bottom rolls.

2. A vertical calender apparatus as in claim 1, wherein the intermediate guide rolls are mounted on lever arms which are controlled by operating cylinders.

* * * * *